US011732997B2

(12) United States Patent
Buckmaster

(10) Patent No.: US 11,732,997 B2
(45) Date of Patent: Aug. 22, 2023

(54) APPARATUS AND METHODS FOR PAINTBALL FEEDING MECHANISM

(71) Applicant: Kyle Buckmaster, League City, TX (US)

(72) Inventor: Kyle Buckmaster, League City, TX (US)

( * ) Notice: Subject to any disclaimer, the term of this patent is extended or adjusted under 35 U.S.C. 154(b) by 194 days.

(21) Appl. No.: 17/401,025

(22) Filed: Aug. 12, 2021

(65) Prior Publication Data

US 2022/0128329 A1 Apr. 28, 2022

Related U.S. Application Data

(60) Provisional application No. 63/078,098, filed on Sep. 14, 2020, provisional application No. 63/070,515, filed on Aug. 26, 2020.

(51) Int. Cl.
*F41B 11/52* (2013.01)
*F41B 11/55* (2013.01)

(52) U.S. Cl.
CPC ..... *F41B 11/55* (2013.01)

(58) Field of Classification Search
CPC ..... F41B 11/55
USPC ..... 124/52
See application file for complete search history.

(56) References Cited

U.S. PATENT DOCUMENTS 5,282,454 A * 2/1994 Bell ..... F41B 11/53 221/21
5,511,333 A * 4/1996 Farrell ..... F41B 11/55 42/49.01
5,794,606 A * 8/1998 Deak ..... F41B 11/57 89/33.17
5,954,042 A * 9/1999 Harvey ..... F41B 11/53 124/52
6,327,953 B1 * 12/2001 Andresen ..... F41B 11/57 89/33.02
6,415,781 B1 * 7/2002 Perrone ..... F41B 11/57 124/49
6,467,473 B1 * 10/2002 Kostiopoulos ..... F41B 11/53 89/33.17
6,488,019 B2 * 12/2002 Kotsiopoulos ..... F41B 11/71 89/33.17
6,644,293 B2 * 11/2003 Jong ..... F42B 39/02 124/52
6,915,792 B1 * 7/2005 Sheng ..... F41B 11/53 124/48
6,935,324 B2 * 8/2005 Watson ..... F41B 11/52 124/49
6,978,776 B2 * 12/2005 Hamilton ..... F41B 11/55 221/277

(Continued)

*Primary Examiner* — Alexander R Niconovich
(74) *Attorney, Agent, or Firm* — Foley & Lardner LLP

(57) ABSTRACT

A paintball feeding apparatus comprising a foregrip, wherein the foregrip is adapted to be disposed around a barrel and/or attached to a receiver of a paintball marker or gun, a base plate having a feeding port, wherein the base plate is adapted to be attached to the foregrip and/or the receiver, a top shell having a loading port and a feeding guide, wherein the top shell is attached to the base plate, a front paddle attached to a follower, a rear paddle attached a charging handle, and a gear box attached to the follower and the charging handle is discussed. Methods of installing and using the paintball feeding apparatus are also disclosed.

22 Claims, 7 Drawing Sheets

(56) References Cited

U.S. PATENT DOCUMENTS 7,222,617 B2 * 5/2007 Andresen ..... F41A 9/02 124/52
7,234,456 B2 * 6/2007 Andresen ..... F41A 9/02 124/48
7,270,121 B2 * 9/2007 Lubben ..... F41B 11/53 124/51.1
7,275,530 B2 * 10/2007 Deak ..... F41B 11/52 124/51.1
7,322,348 B2 * 1/2008 Chen ..... F41B 11/53 124/51.1
7,770,569 B2 * 8/2010 Andresen ..... F41A 9/02 124/51.1
8,047,190 B2 * 11/2011 Kaakkola ..... F41B 11/57 124/1
8,302,586 B2 * 11/2012 Isabelle ..... F41B 11/57 124/49
9,557,136 B2 * 1/2017 Hedberg ..... F41B 11/53
9,658,027 B2 * 5/2017 Stevens ..... F41B 11/51
9,772,159 B2 * 9/2017 Isabelle ..... F41B 11/52
10,393,474 B2 * 8/2019 Sullivan ..... F41B 11/50
10,648,763 B2 * 5/2020 Chia ..... F41B 11/52
10,648,767 B2 * 5/2020 Chia ..... F41B 4/00
11,340,037 B1 * 5/2022 Chia ..... F41B 7/08
11,346,624 B2 * 5/2022 DeRoche ..... F41A 9/02
11,371,798 B1 * 6/2022 Allen ..... F41B 11/73
2006/0191523 A1 * 8/2006 Paletz ..... F41B 11/642 124/67
2007/0151551 A1 * 7/2007 Verini ..... F41B 11/721 124/74
2008/0078368 A1 * 4/2008 Taylor ..... F41A 9/64 124/49
2015/0211827 A1 * 7/2015 Boza ..... F41B 11/55 29/401.1

* cited by examiner

APPARATUS AND METHODS FOR PAINTBALL FEEDING MECHANISM

PRIOR RELATED APPLICATIONS

This application claims benefit of U.S. Provisional Patent Application Ser. No. 63/078,098 entitled "Apparatus and Methods for Paintball Feeding Mechanism," filed on Sep. 14, 2020 and U.S. Provisional Patent Application Ser. No. 63/070,515 entitled "Apparatus and Methods for Paintball Feeding Mechanism," filed on Aug. 26, 2020; both of which are hereby incorporated by reference, for any and all purposes.

FEDERALLY SPONSORED RESEARCH STATEMENT

Not Applicable ("N/A")

REFERENCE TO MICROFICHE APPENDIX

N/A

FIELD OF INVENTION

The present invention relates generally to a paintball feeding mechanism and methods thereof and, more particularly, to an improved paintball feeding mechanism and methods thereof.

BACKGROUND OF THE INVENTION

Hoppers (i.e., awkward-shaped funnels) are standard in the paintball industry. The standard hopper uses gravity or electronic motors to feed projectiles (e.g., paintballs) into a paintball marker or gun. Gravity-fed hoppers tend to jam when the marker or gun is held sideways or upside down. For this reason, other types of loader that suffer other problems such as crushed paintball, and low round counts are being developed and tried. Typically, the hopper has a large maximum capacity of about 150 to about 200 rounds of projectiles. The hopper is big, cumbersome and heavy. Further, they often obstruct the marker or gun sights on the paintball gun.

Q-loaders use a wound spring and rotational feed system to push projectiles (e.g., paintballs) into a paintball marker or gun. Although the Q-loader does not obstruct the marker or gun sights, the Q-loader is still cumbersome and heavy. Their spring tension required to move the projectiles (e.g., paintballs) in a single direction often dimples and crushes the projectiles.

Box magazine (e.g., RAP4 Box Magazine) require complex electronics that must be timed with a firing mechanism of a paintball marker or gun. Although the box magazine does not obstruct the marker or gun sights, the box magazines are still big, cumbersome, heavy, and expensive. They often crush the projectiles (e.g. paintballs). They also frequently jam. Further, their complex electronics fails when wet.

Spring-feed magazines (e.g., 468) use a spring to push projectiles (e.g., paintballs from the bottom of the magazine into the paintball marker or gun. Their spring tension required to move the projectiles (e.g., paintballs) in an upward direction often dimples and crushes the projectiles. They also frequently jam. They are limited to a maximum capacity of about 20 rounds of projectiles. (As a comparison, the standard hopper has a maximum capacity of about 150 to about 200 rounds).

In addition, these hoppers, Q-loaders, box magazines and spring-fed magazines are unreliable for various other reasons.

Thus, an improved paintball feeding apparatus is needed to eliminate these problems.

SUMMARY OF THE INVENTION

The present invention relates generally to a paintball feeding mechanism and methods thereof and, more particularly, to an improved paintball feeding mechanism and methods thereof.

In an embodiment, a paintball feeding apparatus comprises a foregrip, wherein the foregrip is adapted to be disposed around a barrel and/or attached to a receiver of a paintball marker or gun, a base plate having a feeding port, wherein the base plate is adapted to be attached to the foregrip and/or the receiver, a top shell having a loading port and a feeding guide, wherein the top shell is attached to the base plate, a front paddle attached to a follower, a rear paddle attached a charging handle, and a gear box attached to the follower and the charging handle such that, when in operation, the front paddle and the rear paddle move toward the feeding port.

In an embodiment, the base plate and/or top shell are adapted to attach to the paintball marker or gun via a connecting latch.

In an embodiment, the top shell is adapted to hook to the base plate.

In an embodiment, the charging handle is adapted to be held in a retracted position by a retaining hook. In an embodiment, the charging handle is adapted to be released from the retaining hook by a charging handle release button.

In an embodiment, the apparatus further comprises a compression spring attached to the follower, wherein the compression spring is compressed as the follower and the front paddle are pushed towards the feeding port.

In an embodiment, the apparatus further comprises an extension spring attached to the charging handle, wherein the extension spring is extended as the charging handle and the rear paddle are pulled towards the feeding port.

In an embodiment, the feeding guide directs a projectile into the feeding port. In an embodiment, the feeding guide directs a projectile into a cyclone feed of the paintball marker or gun. In an embodiment, the feeding guide has a cone shape, a cylindrical shape, a spherical shape or a portion thereof.

In an embodiment, the top shell has a lid to close the loading port. In an embodiment, the lid is a hinged lid, a latched lid, a press-on lid or a screw-on lid.

In an embodiment, the apparatus further comprises one or more projectiles disposed between the front paddle and the rear paddle. In an embodiment, the one or more projectiles are paintballs, paintball pellets, pepper balls, pepper-spray pellets, or tear gas pellets. In an embodiment, the one or more projectiles are paintballs or paintball pellets. In an embodiment, the one or more projectiles are pepper balls, pepper-spray pellets or tear gas pellets.

In an embodiment, one or more of the foregrip, the base plate, the top shell, the front paddle and the rear paddle are made of aluminum, die-cast zinc, sheet metal, steel or 3D printing plastic.

In an embodiment, a method of installing a paintball feeding apparatus on a paintball marker or gun comprises (a)

providing a paintball feeding apparatus as discussed herein, (b) installing a foregrip around a barrel and/or a receiver of the paintball marker or gun, (c) installing a base plate on the foregrip of the paintball feeding apparatus and/or the receiver of the paintball marker or gun, and (d) installing a top shell on the base plate.

In an embodiment, the method further comprises (e) installing a connecting latch on the receiver of the paintball marker or gun; and (f) holding the base plate with the connecting latch.

In an embodiment, the method further comprises (e) or (g) inserting a retaining pin through a hole in the base plate and/or in the foregrip to secure the paintball feeding apparatus to the paintball marker or gun.

In an embodiment, a method of using a paintball feeding apparatus installed on a paintball marker or gun comprises (a) providing the paintball feeding apparatus installed on a paintball marker or gun, (b) opening a lid for a loading port of the paintball feeding apparatus, (c) pulling or pushing on a charging handle to engage a retention hook and to retract a forward paddle and/or a rear paddle, (d) loading one or more projectiles into the loading port, (e) closing the lid for the loading port, and (f) releasing the charging handle.

In an embodiment, the method further comprises (g) firing one or more projectiles from the paintball marker or gun.

These and other objects, features and advantages will become apparent as reference is made to the following detailed description, preferred embodiments, and examples, given for the purpose of disclosure, and taken in conjunction with the accompanying drawings and appended claims.

BRIEF DESCRIPTION OF THE DRAWINGS

For a further understanding of the nature and objects of the present invention, reference should be made to the following detailed disclosure, taken in conjunction with the accompanying drawings, in which like parts are given like reference numerals, and wherein:

FIG. 1B illustrates an A-A cross-sectional view of the paintball feeding apparatus of FIG. 1A, showing a front paddle in a retracted position, a rear paddle in a retracted position and a plurality of projectiles (e.g., paintballs) there between;

FIG. 2B illustrates an A-A cross-sectional view of the paintball feeding apparatus of FIG. 2A, showing a front paddle in an extended position, a rear paddle in an extended position and a plurality of projectiles (e.g., paintballs) there between;

DETAILED DESCRIPTION OF EMBODIMENTS OF THE INVENTION

The following detailed description of various embodiments of the present invention references the accompanying drawings, which illustrate specific embodiments in which the invention can be practiced. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains. Therefore, the scope of the present invention is defined only by the appended claims, along with the full scope of equivalents to which such claims are entitled.

Suitable Paintball Markers or Guns

Figure 1A:
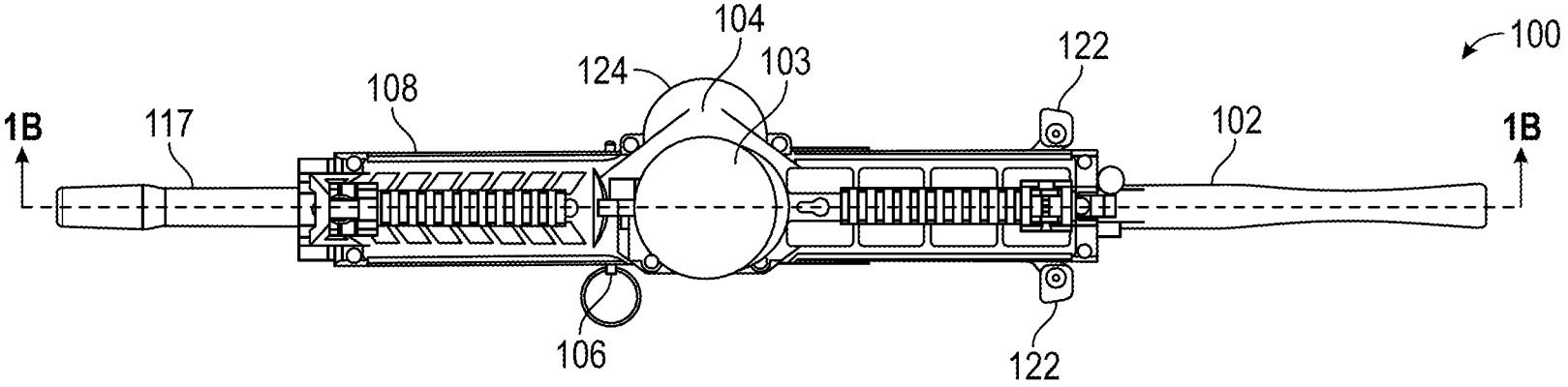
FIG. 1A illustrates a top view of a paintball feeding apparatus mounted on a paintball marker or gun according to an embodiment of the invention, showing a loading port, a retaining pin, and a top shell.
Figure 1B:
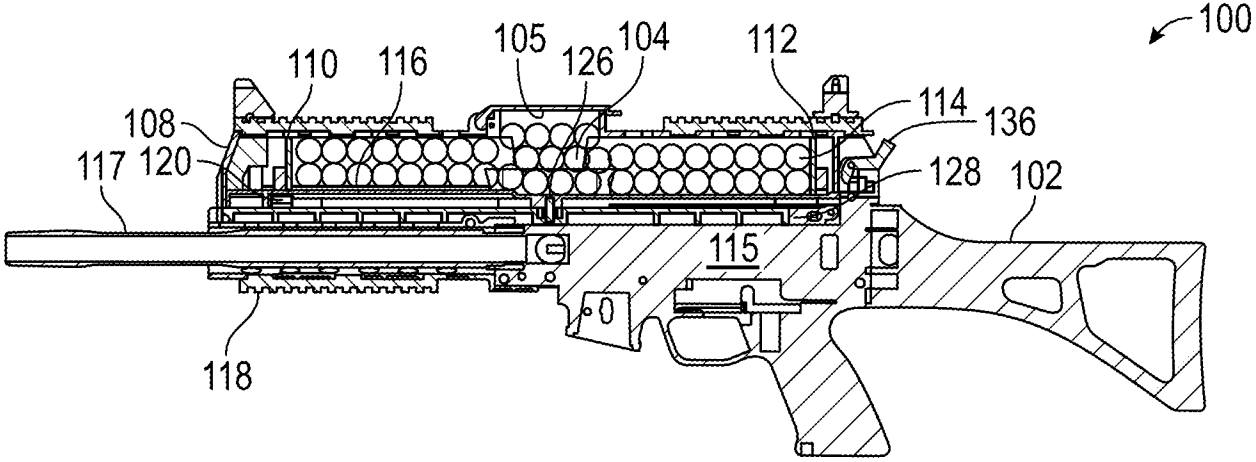

FIG. 1A illustrates a top view of a paintball feeding apparatus 100 mounted on a paintball marker or gun 102 according to an embodiment of the invention; and FIG. 1B illustrates an A-A cross-sectional view of the paintball feeding apparatus of FIG. 1A.

Figure 2A:
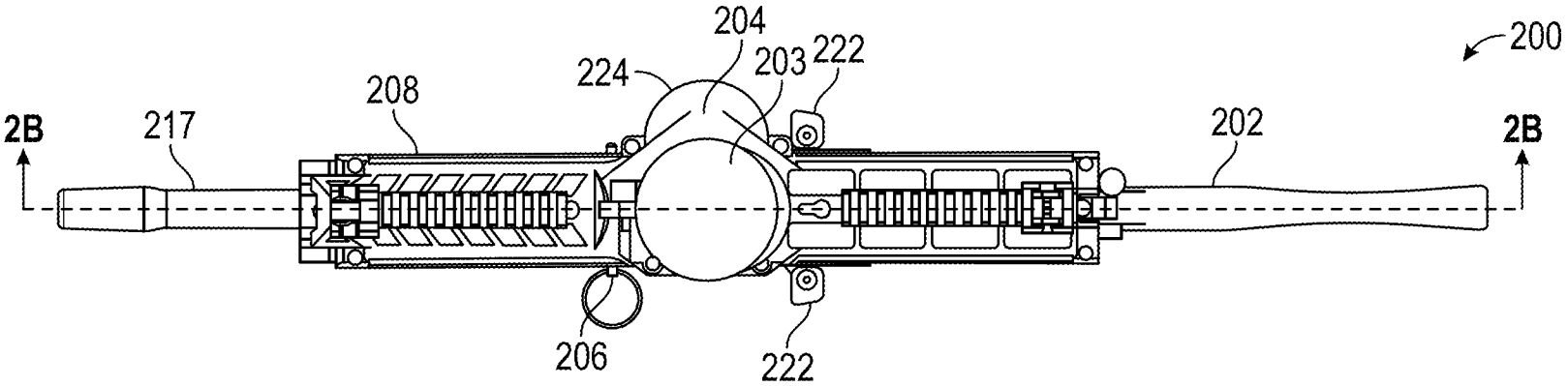
FIG. 2A illustrates a top view for the paintball feeding apparatus according to an embodiment of the invention, showing a loading port, a retaining pin, and a top shell.
Figure 2B:
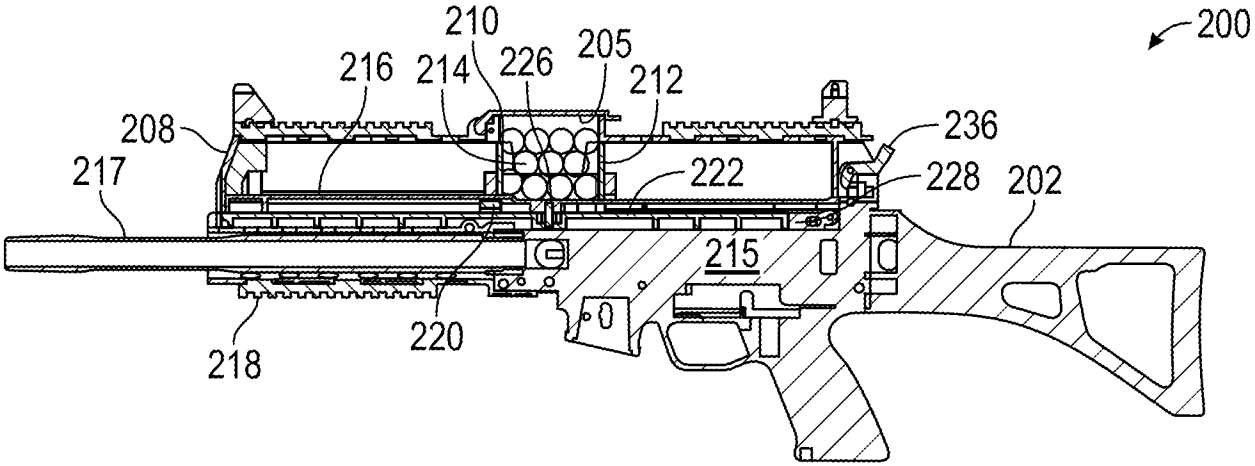

FIG. 2A illustrates a top view for the paintball feeding apparatus 200 mounted on a paintball marker or gun 202 according to an embodiment of the invention; and FIG. 2B illustrates an A-A cross-sectional view of the paintball feeding apparatus of FIG. 2A.

As shown in FIGS. 1A-2B, the paintball feeding apparatus 100, 200 may be installed on and used with any suitable paintball marker or gun 102, 202. For example, suitable paintball markers guns 102, 202 include, but are not limited to, a Tippmann Cronus Basic paintball marker or gun, a Tippmann Cronus Tactical paintball marker or gun, a Tippmann X7 Phenom paintball marker or gun, a Tippmann 98 Platinum paintball marker or gun, A Tippmann A-5 paintball marker or gun, a Tippmann US Army Project Salvo paintball marker or gun, an Azodin Blitz 3 paintball marker or gun, a Spyder Victor paintball marker or gun, an Empire Mini GS paintball marker or gun, a Planet Eclipse Etha 2 paintball marker or gun, a Planet Eclipse GTEK paintball marker or gun, Dye Assault Matrix (DAM) paintball marker or gun, Empire BT D*fender paintball maker or gun, and equivalents thereof.

In an embodiment, the paintball feeding apparatus 100, 200 may be installed on a Tippmann X7 Phenom paintball marker or gun 102, 202.

Paintball Feeding Apparatus

FIG. 1A illustrates a top view of a paintball feeding apparatus 100 mounted on a paintball marker or gun 102 according to an embodiment of the invention, showing a loading port 104, a retaining pin 106, and a top shell 108; and FIG. 1B illustrates an A-A cross-sectional view of the paintball feeding apparatus of FIG. 1A, showing a front paddle 110 in a retracted position, a rear paddle 112 in a retracted position and one or more projectiles (e.g., paintballs) 114 there between.

FIG. 2A illustrates a top view for the paintball feeding apparatus 200 mounted on a paintball marker or gun 202 according to an embodiment of the invention, showing a loading port 204; and FIG. 2B illustrates an A-A cross-sectional view of the paintball feeding apparatus of FIG. 2A, showing a front paddle 210 in an extended position, a rear paddle 212 in an extended position and one or more projectiles (e.g., paintballs) 214 there between.

As shown in FIGS. 1A-1B and 2A-2B, the paintball feeding apparatus 100, 200 may be installed on a paintball marker or gun 102, 202.

The paintball marker or gun 102, 202 may have a receiver 115, 215 and a barrel 117, 217.

In an embodiment, the paintball feeding apparatus 100, 200 may have a top shell 108, 208, a base plate 116, 216 and a foregrip 118, 218.

In an embodiment, a baseplate 116, 216 of the paintball feeding apparatus 100, 200 may be attached to the receiver 115, 215 of the paintball marker or gun 102, 202 via a fastener. The fastener may be any suitable fastener. For example, a suitable fastener includes, but is not limited to, a bolt, a guide pin, a retaining pin, a screw, and combinations thereof. In an embodiment, the fastener may be a bolt or a screw.

In an embodiment, the base plate 116, 216 of the paintball feeding apparatus 100, 200 may be attached to the paintball marker or gun 102, 202 via a connecting latch 136, 236.

In an embodiment, a foregrip 118, 218 of the paintball feeding apparatus may be disposed around a portion of a barrel 117, 217 of the paintball marker or gun 102, 202. In an embodiment, the foregrip 115, 216 of the paintball feeding apparatus 100, 200 may be attached to the receiver 115, 215 of the paintball marker or gun 102, 202 via a fastener. The fastener may be any suitable fastener. For example, a suitable fastener includes, but is not limited to, a bolt, a guide pin, a retaining pin, a screw, and combinations thereof. In an embodiment, the fastener may be a bolt or a screw.

In an embodiment, the top shell 108, 208, may be attached to the base plate 116, 216 via a fastener. The fastener may be any suitable fastener. For example, a suitable fastener includes, but is not limited to, a bolt, a hook, a latch, a guide pin, a screw, a retaining pin, and combinations thereof. In an embodiment, the fastener may be a hook and a latch.

In an embodiment, the top shell 108, 208 may have a loading port 103, 203, a feeding guide 104, 204, and a feeding port 124, 224.

In an embodiment, the loading port 103, 203 may have a lid 105, 205. The lid 105, 205 may be any suitable lid. For example, suitable lids 105, 205 include, but are not limited to, a hinged lid, a latched lid, a press-on lid, a screw-on lid, and combinations thereof. In an embodiment, the lid 105, 205 is a hinged lid.

In an embodiment, the lid 105, 205 may be attached to the top shell 108, 208, via a fastener. The fastener may be any suitable fastener. For example, a suitable fastener includes, but is not limited to, a bolt, a hinge, a latch, a screw, a retaining pin, a threaded connection, and combinations thereof. In an embodiment, the fastener may be a hinge or a latch.

In an embodiment, the feeding guide 104, 204 restricts the flow of projectiles (e.g., paintballs) 114, 214 into a cyclone feed for the paintball marker or gun. The feeding guide 104, 204 may be any suitable shape to restrict the flow of projectiles (e.g., paintballs) 114, 214 into the cyclone feed and/or to create a void above the cyclone feed. Suitable shapes include, but are not limited to, a cone, a cylinder, a rectangular prism (e.g., cube, cuboid), a sphere, and combinations and/or portions thereof.

In an embodiment, the shape is a portion of a cylinder or a portion of a sphere.

In an embodiment, the feeding guide 104, 204 directs the projectiles (e.g., paintballs) 114, 214 to the feeding port 124, 224 into the cyclone feed of the paintball marker or gun.

In an embodiment, the base plate 116, 216 assembly may have retaining pin 106, 206, a front paddle 110, 210, a rear paddle 112, 212, a follower 120, 220, a charging handle 122, 222, and a gear box 126, 226.

In an embodiment, the front paddle 110, 210 is attached to the follower 120, 220 of the paintball feeding apparatus 100, 200 via a fastener. The fastener may be any suitable fastener. For example, a suitable fastener includes, but is not limited to, a bolt, a guide pin, a retaining pin, a screw, and combinations thereof. In an embodiment, the fastener may be a bolt or a guide pin or a screw.

In an embodiment, the front paddle 110, 210 is attached to the follower 120, 220 of the paintball feeding apparatus 100, 200 via a fastener disposed through the base plate 116, 216 of the paintball feeding apparatus 100, 200. The fastener may be any suitable fastener. For example, a suitable fastener includes, but is not limited to, a bolt, a guide pin, a screw, and combinations thereof. In an embodiment, the fastener may be a bolt or a guide pin or a screw.

In an embodiment, the rear paddle 112, 212 is attached to the charging handle 122, 222 of the paintball feeding apparatus 100, 200 via a fastener. The fastener may be any suitable fastener. For example, a suitable fastener includes, but is not limited to, a bolt, a guide pin, a retaining pin, a screw, and combinations thereof. In an embodiment, the fastener may be a bolt or a guide pin or a screw.

In an embodiment, the rear paddle 112, 212 is attached to the charging handle 122, 222 of the paintball feeding apparatus 100, 200 via a fastener disposed through the base plate 116, 216 of the paintball feeding apparatus 100, 200. The fastener may be any suitable fastener. For example, a suitable fastener includes, but is not limited to, a bolt, a guide pin, a retaining pin, a screw, and combinations thereof. In an embodiment, the fastener may be a bolt or a guide pin or a screw.

The front paddle 110, 210 and the rear paddle 112, 212 may be any suitable paddle. For example, a suitable front paddle 110, 210 and/or rear paddle 112, 212 include, but are not limited to a padded paddle, a perforated paddle, smooth paddle, and combinations thereof.

In an embodiment, the front paddle 110, 210 and the rear paddle 112, 212 are smooth paddles.

In an embodiment, the front paddle 110, 210 and the rear paddle 112, 212 move the projectiles (e.g., paintballs) towards the feeding guide 104, 204. The front paddle 110, 210 and the rear paddle 112, 212 may be any suitable shape to move the flow of projectiles (e.g., paintballs) 114, 214 toward the feeding guide 104, 204. Suitable shapes include, but are not limited to, a circle, a hexagon, an octagon, a pentagon, a rectangle, a square, a trapezoid, and combinations and/or portions thereof.

In an embodiment, the shape is a trapezoid.

In an embodiment, the follower 120, 220 and the charging handle 122, 222 are connected by the gear box 126, 226.

The gear box 126, 226 may be any suitable gear box. For example, a suitable gear box 126, 226 includes, but is not limited to, a dual rack and pinion gear box, and a rack and pinion gear box, and equivalents thereof.

The gear box 126, 226 may have any suitable gear ratio. For example, if the travel distances for the front paddle 110, 210 and the rear paddle 112, 212 are the same, the gear ratio would be 1:1. If the travel distances for the front paddle 110, 210 and the rear paddle 112, 212 are not the same, the gear would be different than 1:1 to compensate for the difference in travel distances (and timing of the paddles) to provide a relatively constant feed of projectiles (e.g., paintballs) from both directions to the feeding port 124, 224.

In an embodiment, the charging handle 122, 222 may be adapted to be held in a retracted position by a retaining hook 128, 228.

In an embodiment, the charging handle 122, 222 (and/or retaining hook 128, 228) may be adapted to be released from the retracted position by a pressing charging handle release button (not shown). See e.g., FIGS. 3B: 330 & 4B: 430.

The feeding guide 104, 204, the lid 105, 205, the top shell 108, 208, the front paddle 110, 210, and the rear paddle 112, 212, the base plate 116, 216, the foregrip 118, 218, the follower 120, 220, the charging handle 122, 224, and/or the gear box 126, 226 of the paint ball apparatus 100, 200 may be made of any suitable metal and/or plastic (e.g., 3D printing plastics) material. For example, suitable metals include, but are not limited to, aluminum, die-cast zinc, sheet metal, steel, stainless steel, and combinations thereof.

In an embodiment, the metal may be an aluminum or a steel.

For example, suitable plastics include, but are not limited to, acrylonitrile butadiene styrene (ABS), carbon fiber, nylon, polycarbonate, polyethylene (PE, HDPE), polyethylene terephthalate (PETG), polypropylene (PP, HDPP), and combinations thereof.

In an embodiment, the plastic may be a 3D printing plastic.

In an embodiment, the paintball feeding apparatus 100, 200 includes one or more projectiles 114, 214 disposed between the front paddle 110, 210 and the rear paddle 112, 212.

The projectiles 114, 214 may be any suitable projectile. For example, suitable projectiles 114, 214 include, but are not limited to, paintballs, paintball pellets, pepper balls (e.g., PAVA pepper balls), pepper-spray pellets (e.g., PAVA pepper pellet), tear gas pellets (e.g., CS gas pellets), and equivalents thereof.

The projectiles 114, 214 may be any suitable shape. For example, suitable shapes include, but are not limited to, a cone, a cylinder, a hexagonal prism, a hexagonal pyramid, a rectangular prism (e.g., cube, cuboid), a rectangular pyramid, a sphere (e.g., ball, ovoid), a square pyramid, a torus (e.g., donut), a triangular prism, a triangular pyramid, and variations thereof.

In an embodiment, the shape may be a sphere or an ovoid.

Figure 3A:
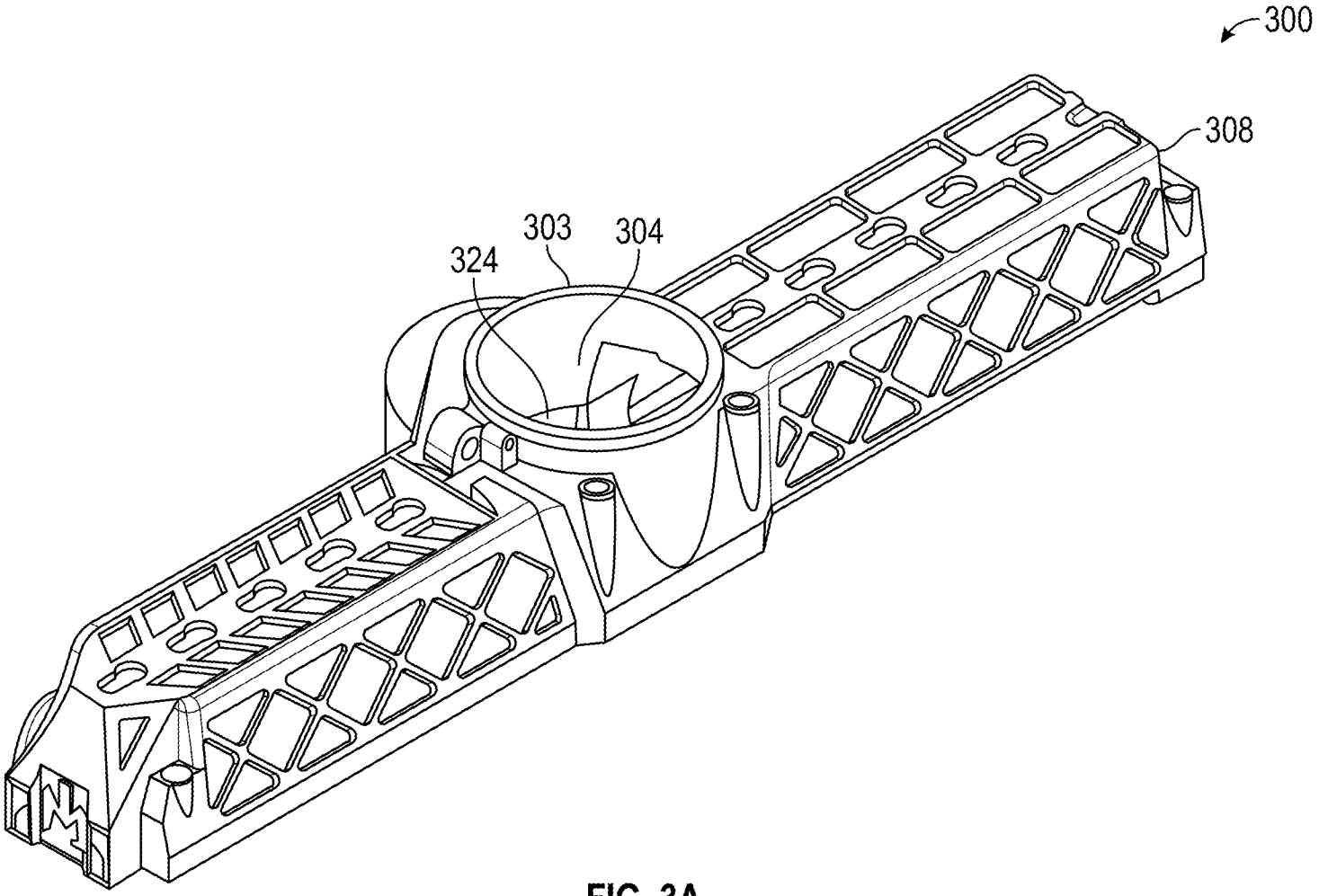
FIG. 3A illustrates a front, left side view of a top shell for the paintball feeding apparatus according to an embodiment of the invention, showing a loading port.
Figure 3B:
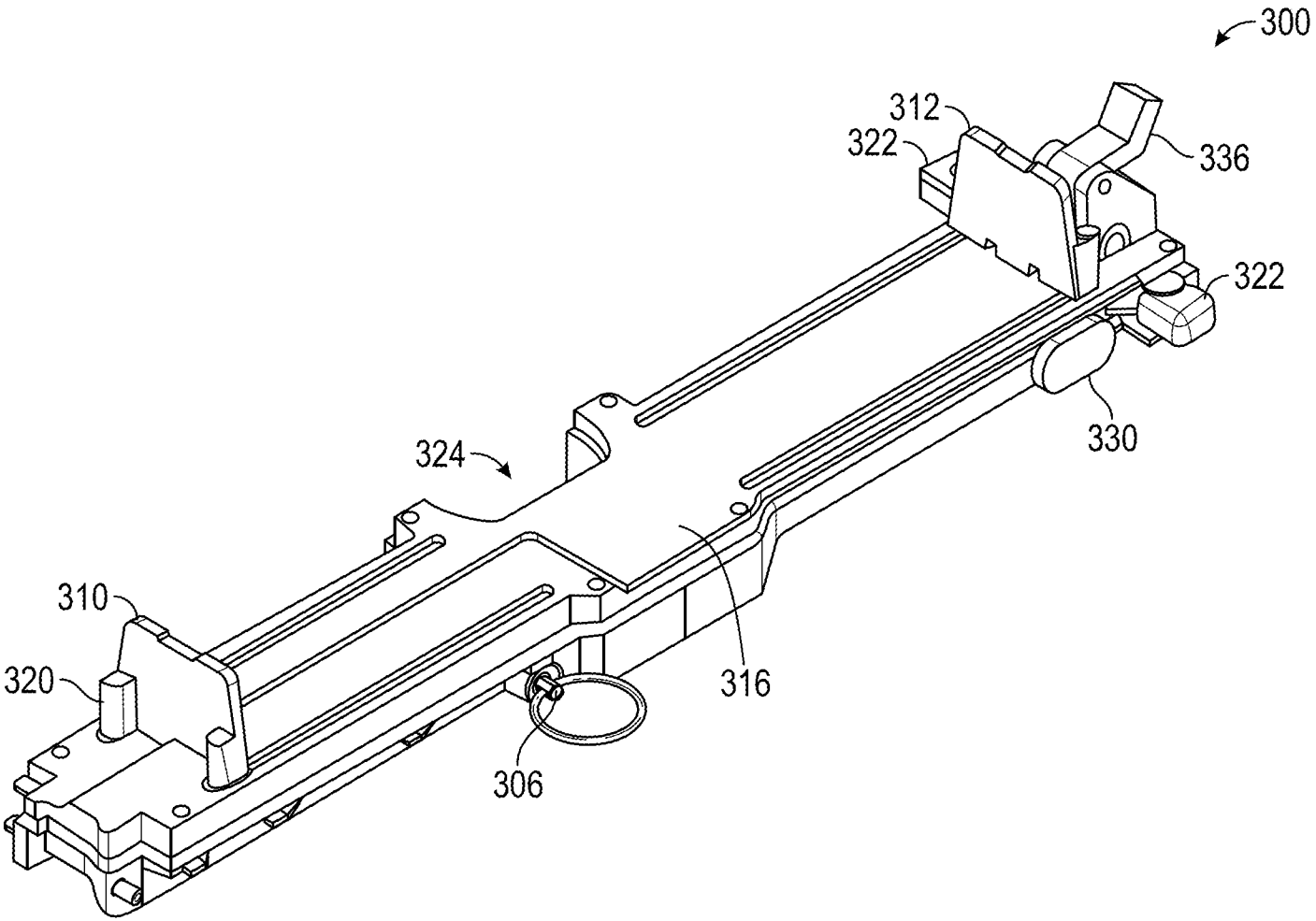
FIG. 3B illustrates a front, left side view of a base plate for the paintball feeding apparatus according to an embodiment of the invention, showing a front paddle in a retracted position, and a rear paddle in a retracted position.

FIG. 3A illustrates a front, left side view of a top shell 308 for the paintball feeding apparatus 300 according to an embodiment of the invention, showing a loading port 303; and FIG. 3B illustrates a front, left side view of a base plate 316 for the paintball feeding apparatus 300 according to an embodiment of the invention, showing a front paddle 310 in a retracted position, and a rear paddle 312 in a retracted position.

As shown in FIGS. 3A, the top shell 308 may have a loading port 303, a feeding guide 304 and a feeding port 324.

In an embodiment, the feeding guide 304 restricts the flow of projectiles (e.g., paintballs) 114, 214 into a cyclone feed for the paintball marker or gun. The feeding guide 304 may be any suitable shape to restrict the flow of projectiles (e.g., paintballs) 114, 214 into the cyclone feed and/or to create a void above the cyclone feed. Suitable shapes include, but are not limited to, a cone, a cylinder, a rectangular prism (e.g., cube, cuboid), a sphere, and combinations and/or portions thereof.

In an embodiment, the shape is a portion of a cylinder or a portion of a sphere.

In an embodiment, the feeding guide 304 directs the projectiles (e.g., paintballs) 114, 214 to the feeding port 324 into the cyclone feed of the paintball marker or gun.

As shown in FIG. 3B, the base plate 316 assembly may have retaining pin 306, a front paddle 310, a rear paddle 312, a follower 320, a charging handle 322, and a gear box (not shown).

In an embodiment, the front paddle 310 is attached to the follower 320 via a fastener. The fastener may be any suitable fastener. For example, a suitable fastener includes, but is not limited to, a bolt, a guide pin, a retaining pin, a screw, and combinations thereof. In an embodiment, the fastener may be a bolt or a guide pin or a screw.

In an embodiment, the front paddle 310 is attached to the follower 320 via a fastener disposed through the base plate 316 of the paintball feeding apparatus 300. The fastener may be any suitable fastener. For example, a suitable fastener includes, but is not limited to, a bolt, a guide pin, a screw, and combinations thereof. In an embodiment, the fastener may be a bolt or a guide pin or a screw.

In an embodiment, the rear paddle 312 is attached to the charging handle 322 via a fastener. The fastener may be any suitable fastener. For example, a suitable fastener includes, but is not limited to, a bolt, a guide pin, a retaining pin, a screw, and combinations thereof. In an embodiment, the fastener may be a bolt or a guide pin or a screw.

In an embodiment, the rear paddle 312 is attached to the charging handle 322 via a fastener disposed through the base plate 316. The fastener may be any suitable fastener. For example, a suitable fastener includes, but is not limited to, a bolt, a guide pin, a retaining pin, a screw, and combinations thereof. In an embodiment, the fastener may be a bolt or a guide pin or a screw.

In an embodiment, the follower 320 and the charging handle 322 are connected by the gear box 326.

The gear box 326 may be any suitable gear box. For example, a suitable gear box 326 includes, but is not limited to, a dual rack and pinion gear box, and a rack and pinion gear box, and equivalents thereof.

The gear box 326 may have any suitable gear ratio. For example, if the travel distances for the front paddle 310 and the rear paddle 312 are the same, the gear ratio would be 1:1. If the travel distances for the front paddle 310 and the rear paddle 312 are not the same, the gear would be different than 1:1 to compensate for the difference in travel distances (and timing of the paddles) to provide a relatively constant feed of projectiles (e.g., paintballs) from both directions to the feeding port 324. See e.g., FIGS. 1B: 124 & 2B: 224.

In an embodiment, the charging handle 322 may be adapted to be held in a retracted position by a retaining hook (not shown). See e.g., FIGS. 1B: 128 & 2B: 228.

In an embodiment, the charging handle 322 (and/or retaining hook (not shown)) may be adapted to be released from the retaining hook (not shown) by a pressing charging handle release button 330. See e.g., FIGS. 1B: 128 & 2B: 228.

In an embodiment, the base plate 316 assembly may be attached to the paintball marker or gun 102, 202 via a connecting latch 336.

Figure 4A:
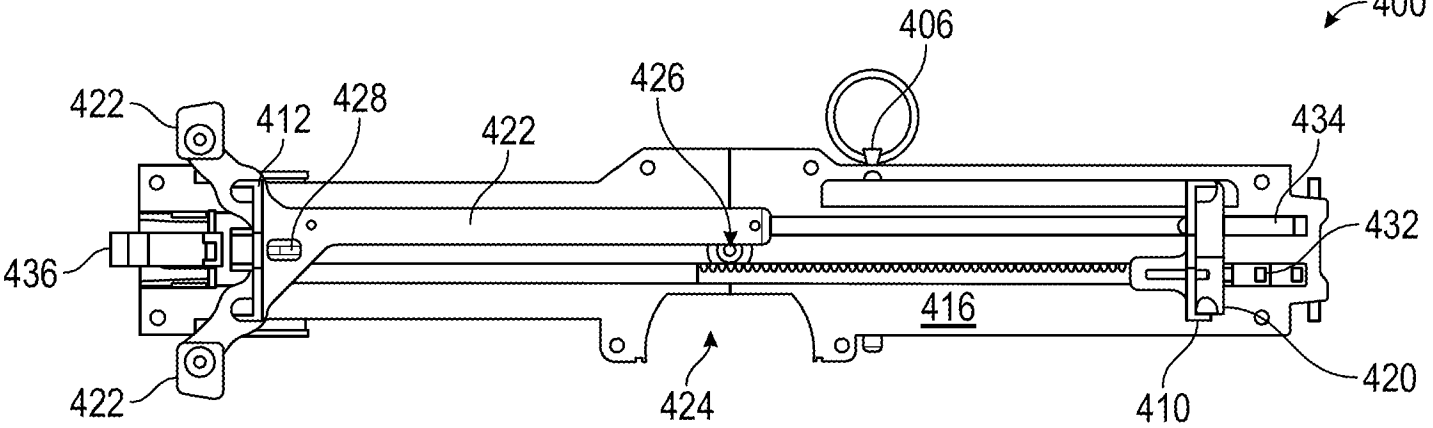
FIG. 4A illustrates a top view of the base plate for the paintball feeding apparatus according to an embodiment of the present invention, showing a front paddle in a retracted position, and a rear paddle in a retracted position.
Figure 4B:
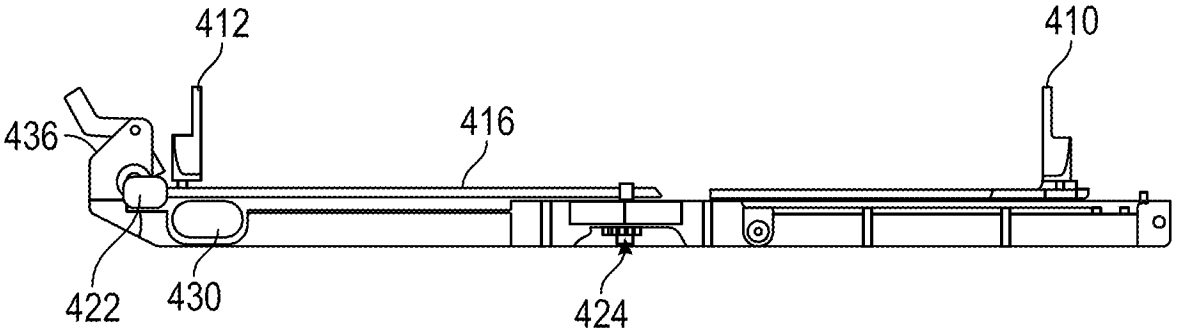
FIG. 4B illustrates a right side view of the paintball feeding apparatus of FIG. 4A, showing the front paddle in a retracted position, and the rear paddle in a retracted position.

FIG. 4A illustrates a top view of the base plate 416 for the paintball feeding apparatus 400 according to an embodiment of the present invention, showing a front paddle 410 in a retracted position, and a rear paddle 412 in a retracted position; and FIG. 4B illustrates a right side view of the paintball feeding apparatus of FIG. 4A, showing the front paddle 410 in a retracted position, and the rear paddle 412 in a retracted position.

As shown in FIGS. 4A and 4B, the base plate 416 assembly may have retaining pin 406, a front paddle 410, a rear paddle 412, a follower (not shown), a charging handle 422, and a gear box 426, a retaining hook 428, a charging handle release button 430, a compression spring 432, an extension spring 434, and a connecting latch 436. See e.g., FIGS. 1B; 120, 2B: 220 & 3B: 320.

In an embodiment, the front paddle 410 is attached to the follower 420 via a fastener. The fastener may be any suitable fastener. For example, a suitable fastener includes, but is not limited to, a bolt, a guide pin, a retaining pin, a screw, and combinations thereof. In an embodiment, the fastener may be a bolt or a guide pin or a screw.

In an embodiment, the front paddle 410 is attached to the follower 420 via a fastener disposed through the base plate 416. The fastener may be any suitable fastener. For example, a suitable fastener includes, but is not limited to, a bolt, a guide pin, a screw, and combinations thereof. In an embodiment, the fastener may be a bolt or a guide pin or a screw.

In an embodiment, the rear paddle 412 is attached to the charging handle 422 via a fastener. The fastener may be any suitable fastener. For example, a suitable fastener includes, but is not limited to, a bolt, a guide pin, a retaining pin, a screw, and combinations thereof. In an embodiment, the fastener may be a bolt or a guide pin or a screw.

In an embodiment, the rear paddle 412 is attached to the charging handle 422 via a fastener disposed through the base plate 416. The fastener may be any suitable fastener. For example, a suitable fastener includes, but is not limited to, a bolt, a guide pin, a retaining pin, a screw, and combinations thereof. In an embodiment, the fastener may be a bolt or a guide pin or a screw.

In an embodiment, the follower 420 and the charging handle 422 are connected by the gear box 426.

The gear box 426 may be any suitable gear box. For example, a suitable gear box 426 includes, but is not limited to, a dual rack and pinion gear box, and a rack and pinion gear box, and equivalents thereof.

The gear box 426 may have any suitable gear ratio. For example, if the travel distances for the front paddle 410 and the rear paddle 412 are the same, the gear ratio would be 1:1. If the travel distances for the front paddle 410 and the rear paddle 412 are not the same, the gear would be different than 1:1 to compensate for the difference in travel distances (and timing of the paddles) to provide a relatively constant feed of projectiles (e.g., paintballs) from both directions to the feeding port 424. See e.g., FIGS. 1B: 124 & 2B: 224.

In an embodiment, the charging handle 422 may be adapted to be held in a retracted position by a retaining hook 428.

In an embodiment, the charging handle 422 (and/or retaining hook 428) may be adapted to be released from the retracted position by a pressing charging handle release button 430.

In an embodiment, a compression spring 432 is compressed as the follower 420 (and the front paddle 410) are pushed towards the feeding port 424.

In an embodiment, an extension spring 434 is extended as the charging handle 422 (and the rear paddle 412) are pulled toward the feeding port 424, keeping tension on the charging handle 422.

The compression spring 432 and the extension spring 434 may be any suitable spring.

In an embodiment, the base plate 416 assembly may be attached to the paintball marker or gun 102, 202 via a connecting latch 436.

Method for Installing Paintball Feeding Apparatus

Figure 5:
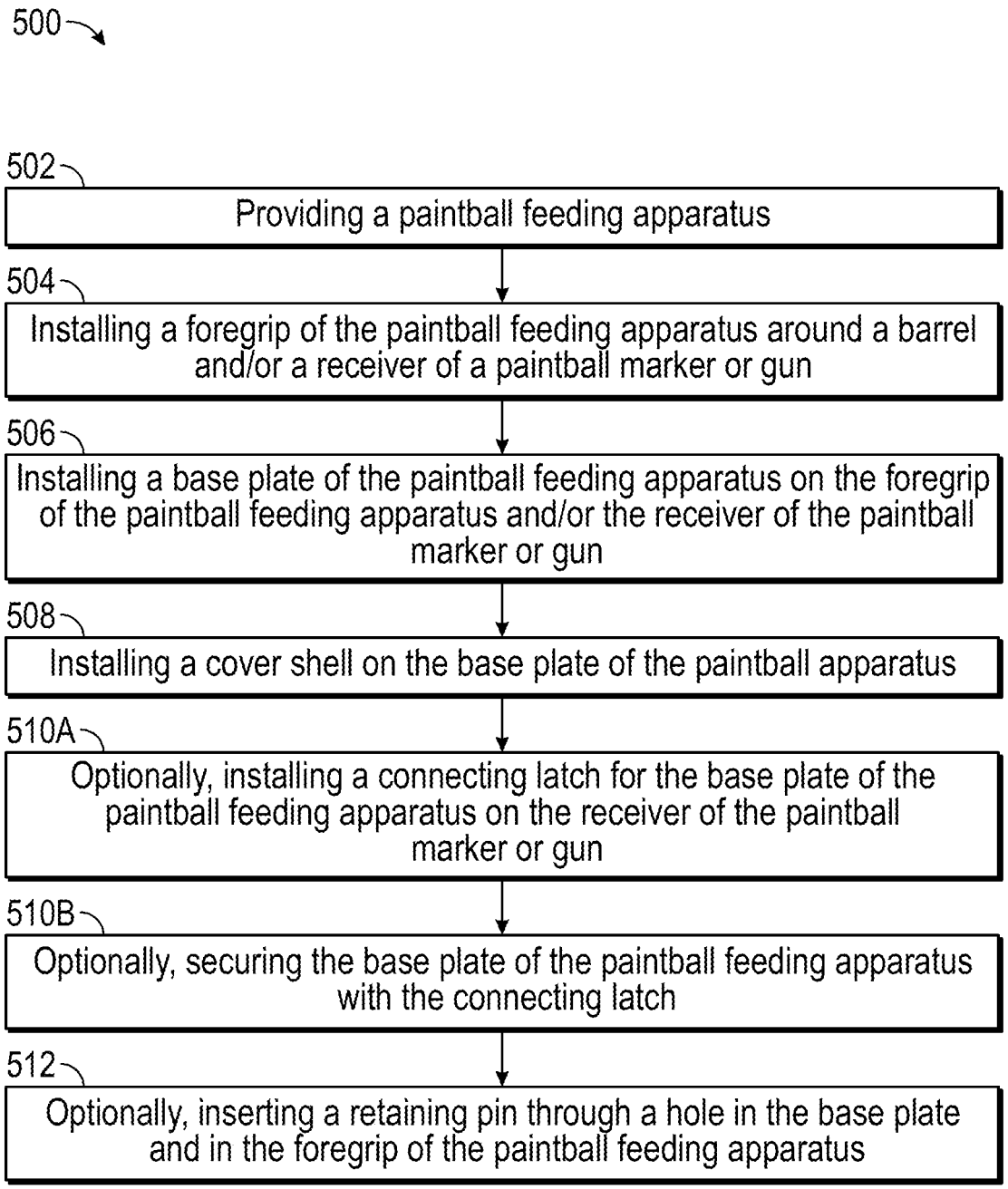
FIG. 5 illustrates a flowchart for a method for installing the paintball feeding apparatus according to an embodiment of the invention.

FIG. 5 illustrates a flowchart for a method for installing the paintball feeding apparatus according to an embodiment of the invention.

As shown in FIG. 5, the method may include (a) providing a paintball feeding apparatus as described herein 502, (b) installing a foregrip of the paintball feeding apparatus around a barrel and/or a receiver of a paintball marker or gun 504; (c) installing a base plate of the paintball feeding apparatus on the foregrip of the paintball feeding apparatus and/or the receiver of the paintball marker or gun 506, and (d) installing a top shell on the base plate of the paintball feeding apparatus 508.

In an embodiment, the method further comprises: (e) installing a connecting latch for the base plate of the paintball feeding apparatus on the receiver of the paintball marker or gun 510*a*, and (f) securing the base plate of the paintball feeding apparatus with the connecting latch 510*b*.

In an embodiment, the method further includes (e) or (g) inserting a retaining pin through a hole in the base plate and/or in the foregrip of the paintball feeding apparatus to secure the paintball feeding apparatus to the paintball marker or gun 512.

In an embodiment, the foregrip 118, 218 of the paintball feeding apparatus 100, 200 is adapted to fit a particular paintball marker or gun 102, 202. For some paintball markers or guns 102, 202, a portion of the barrel 117, 217 may be modified and/or a portion may be removed so that the foregrip 118, 218 of the paintball feeding apparatus 100, 200 fits better.

In an embodiment, the base plate 116, 216 is adapted to fit a particular paintball marker or gun 102, 202. For some paintball markers or guns 102, 202, a portion of the receiver 115, 215 of the paintball marker or gun 102, 202 may be modified or a portion may be removed so that the base plate 116, 216 of the paintball feeding apparatus 100, 200 fits better and/or sits lower.

Method of Using Paintball Feeding Apparatus

Figure 6:
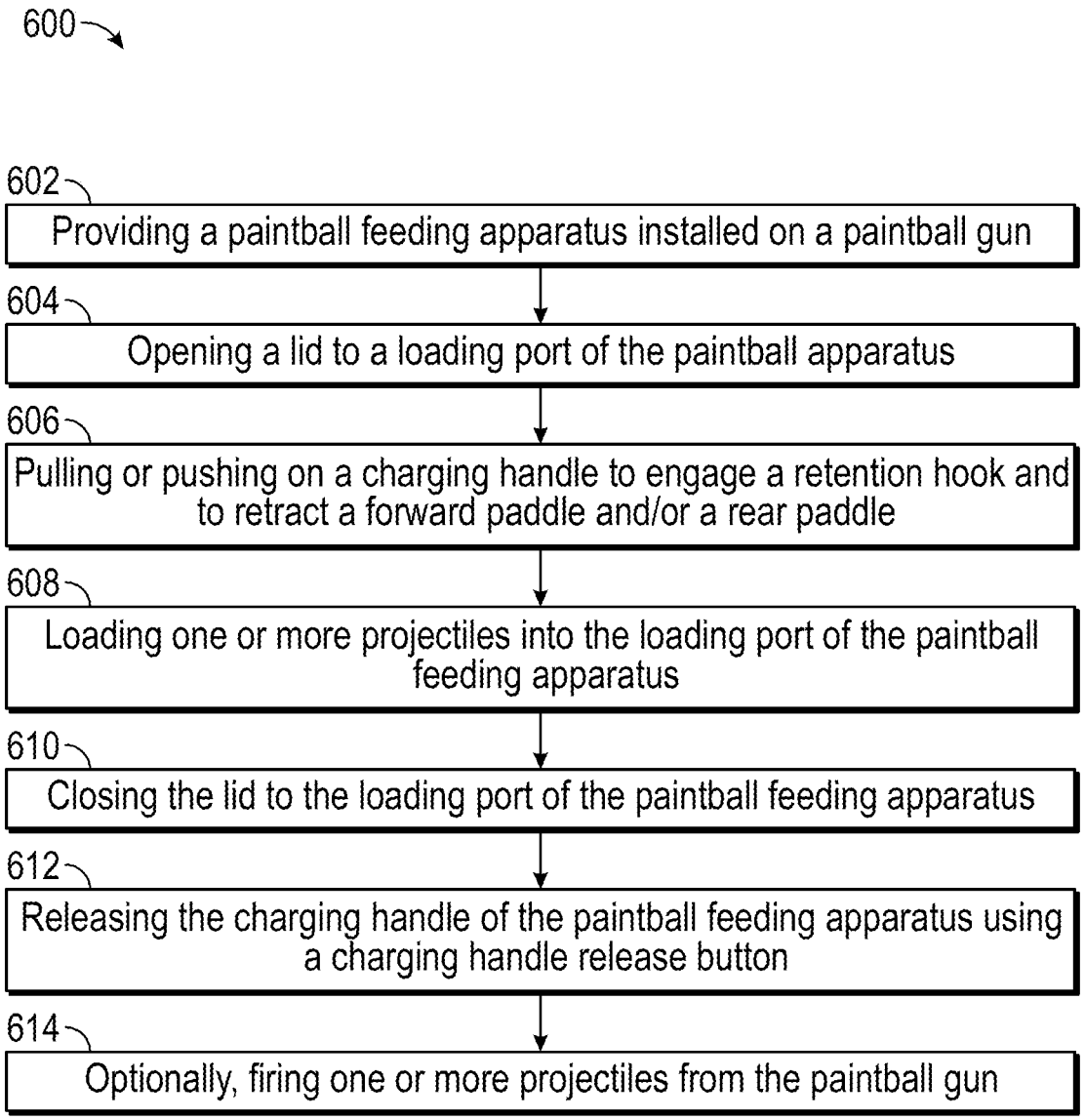
FIG. 6 illustrates a method of using the paintball feeding apparatus according to an embodiment of the invention.

FIG. 6 illustrates a method of using the paintball feeding apparatus according to an embodiment of the invention.

As shown in FIG. 6, the method 600 may include providing a paintball feeding apparatus installed on a paintball marker or gun as described herein 602, opening a lid to a loading port of the paintball feeding apparatus 604; pulling or pushing on a charging handle to engage a retention hook and to retract a forward paddle and/or a rear paddle 606, loading one or more projectiles (e.g., paintballs) into the loading port of the paintball feeding apparatus 608, closing the lid to the loading port of the paintball feeding apparatus 610, and releasing the charging handle of the paintball feeding apparatus using a charging handle release button 612.

In an embodiment, the method further includes firing one or more projectiles from the paintball marker or gun 614.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms (e.g., "outer" and "inner," "upper" and "lower," "first" and "second," "internal" and "external," "above" and "below" and the like) are used as words of convenience to provide reference points and, as such, are not to be construed as limiting terms.

The embodiments set forth herein are presented to best explain the present invention and its practical application and to thereby enable those skilled in the art to make and utilize the invention. However, those skilled in the art will recognize that the foregoing description has been presented for the purpose of illustration and example only. The description as set forth is not intended to be exhaustive or to limit the invention to the precise form disclosed. Many modifications and variations are possible in light of the above teaching without departing from the spirit and scope of the following claims.

Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

Definitions

As used herein, the terms "a," "an," "the," and "said" mean one or more, unless the context dictates otherwise.

As used herein, the term "about" means the stated value plus or minus a margin of error plus or minus 10% if no method of measurement is indicated.

As used herein, the term "or" means "and/or" unless explicitly indicated to refer to alternatives only or if the alternatives are mutually exclusive.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "containing," "contains," and "contain" have the same open-ended meaning as "comprising," "comprises," and "comprise," provided above.

As used herein, the terms "having," "has," and "have" have the same open-ended meaning as "comprising," "comprises," and "comprise," provided above.

As used herein, the terms "including," "includes," and "include" have the same open-ended meaning as "comprising," "comprises," and "comprise," provided above.

As used herein, the phrase "consisting of" is a closed transition term used to transition from a subject recited before the term to one or more material elements recited after the term, where the material element or elements listed after the transition term are the only material elements that make up the subject.

As used herein, the term "simultaneously" means occurring at the same time or about the same time, including concurrently.

Incorporation By Reference

All patents and patent applications, articles, reports, and other documents cited herein are fully incorporated by reference to the extent they are not inconsistent with this invention.

What is claimed is:

1. A paintball feeding apparatus comprising:

(a) a foregrip, wherein the foregrip is adapted to be disposed around a barrel and/or attached to a receiver of a paintball marker or gun;

(b) a base plate having a feeding port, wherein the base plate is adapted to be attached to the foregrip and/or the receiver;

(c) a top shell having a loading port and a feeding guide, wherein the top shell is attached to the base plate;

(d) a front paddle attached to a follower;

(e) a rear paddle attached a charging handle; and (f) a gear box attached to the follower and the charging handle such that, when in operation, the front paddle and the rear paddle move toward the feeding port.

2. The apparatus of claim 1, wherein the base plate and/or top shell are adapted to attach to the paintball marker or gun via a connecting latch.

3. The apparatus of claim 1, wherein the top shell is adapted to hook to the base plate.

4. The apparatus of claim 1, wherein the charging handle is adapted to be held in a retracted position by a retaining hook.

5. The apparatus of claim 4, wherein the charging handle is adapted to be released from the retaining hook by a charging handle release button.

6. The apparatus of claim 1, further comprising a compression spring attached to the follower, wherein the compression spring is compressed as the follower and the front paddle are pushed towards the feeding port.

7. The apparatus of claim 1, further comprising an extension spring attached to the charging handle, wherein the extension spring is extended as the charging handle and the rear paddle are pulled towards the feeding port.

8. The apparatus of claim 1, wherein the feeding guide directs a projectile into the feeding port.

9. The apparatus of claim 1, wherein the feeding guide directs a projectile into a cyclone feed of the paintball marker or gun.

10. The apparatus of claim 1, wherein the feeding guide has a cone shape, a cylindrical shape, a spherical shape or a portion thereof.

11. The apparatus of claim 1, wherein the top shell has a lid to close the loading port.

12. The apparatus of claim 11, wherein the lid is a hinged lid, a latched lid, a press-on lid and a screw-on lid.

13. The apparatus of claim 1, further comprising one or more projectiles disposed between the front paddle and the rear paddle.

14. The apparatus of claim 13, wherein the one or more projectiles are paintballs, paintball pellets, pepper balls, pepper-spray pellets, or tear gas pellets.

15. The apparatus of claim 14, wherein the one or more projectiles are paintballs or paintball pellets.

16. The apparatus of claim 14, wherein the one or more projectiles are pepper balls, pepper-spray pellets or tear gas pellets.

17. The apparatus of claim 1, wherein one or more of the foregrip, the base plate, the top shell, the front paddle and the rear paddle are made of aluminum, die-cast zinc, sheet metal, steel or 3D printing plastic.

18. A method of installing a paintball feeding apparatus on a paintball marker or gun comprising:

(a) providing a paintball feeding apparatus of claim 1;

(b) installing a foregrip around a barrel and/or a receiver of the paintball marker or gun;

(c) installing a base plate on the foregrip of the paintball feeding apparatus and/or the receiver of the paintball marker or gun; and (d) installing a top shell on the base plate.

19. The method of claim 18 further comprising:

(e) installing a connecting latch on the receiver of the paintball marker or gun; and (f) holding the base plate with the connecting latch.

20. The method of claim 18 further comprising:

(e) inserting a retaining pin through a hole in the base plate and/or in the foregrip to secure the paintball feeding apparatus to the paintball marker or gun.

21. A method of using a paintball feeding apparatus installed on a paintball marker or gun comprising:

(a) providing the paintball feeding apparatus of claim 1 installed on a paintball marker or gun;

(b) opening a lid for a loading port of the paintball feeding apparatus;

(c) pulling or pushing on a charging handle to engage a retention hook and to retract a forward paddle and/or a rear paddle;

(d) loading one or more projectiles into the loading port;

(e) closing the lid for the loading port; and (f) releasing the charging handle.

22. The method of claim 21, further comprising:

(g) firing one or more projectiles from the paintball marker or gun.

* * * * *